US006612062B1

(12) United States Patent
Howard et al.

(10) Patent No.: US 6,612,062 B1
(45) Date of Patent: Sep. 2, 2003

(54) CARRIER LOCKING DEVICE

(75) Inventors: Bradley Phillip Howard, Rineyville, KY (US); Edward Donald Schoppman, Elizabethtown, KY (US)

(73) Assignee: R.A. Brands, L.L.C., Madison, NC (US)

( * ) Notice: Subject to any disclaimer, the term of this patent is extended or adjusted under 35 U.S.C. 154(b) by 174 days.

(21) Appl. No.: 09/788,920

(22) Filed: Feb. 20, 2001

(51) Int. Cl.[7] ..... F41A 3/00

(52) U.S. Cl. ..... 42/17; 42/21; 42/29; 42/33; 42/35; 42/37; 42/39; 42/6; 89/33.01; 89/33.1

(58) Field of Search ..... 42/17, 21, 29, 42/33, 35, 37, 39, 6; 89/33.01, 33.03, 33.1

(56) References Cited

U.S. PATENT DOCUMENTS

| | | | | | |
|---|---|---|---|---|---|
| 2,675,638 A | | 4/1954 | Crittendon | ..... | 42/17 |
| 3,389,487 A | | 6/1968 | Benelli | ..... | 42/17 |
| 4,276,707 A | * | 7/1981 | Hayashi | ..... | 42/17 |
| 4,856,217 A | | 8/1989 | Benelli | ..... | 42/17 |
| 6,044,580 A | | 4/2000 | Beretta | ..... | 42/17 |

* cited by examiner

*Primary Examiner*—J. Woodrow Eldred
(74) *Attorney, Agent, or Firm*—Womble Carlyle Sandridge & Rice, P.L.L.C.

(57) ABSTRACT

A carrier lock for use in semi-automatic firearms.

7 Claims, 3 Drawing Sheets

CARRIER LOCKING DEVICE

BACKGROUND OF THE INVENTION

The present invention relates generally to semi-automatic firearms. More specifically, the present invention relates to a carrier lock device for use in such firearms.

Firearms that include mechanisms that cause ammunition to self load and self expend are generally referred to as "autoloading". Autoloaders can either be semi-automatic, selectively automatic, or fully automatic. The autoloading function of any firearm requires exact timing of a repetitive sequence consisting of: (1) loading a cartridge, (2) firing the cartridge, and (3) ejecting the spent cartridge from the firearm. Any mishaps during any one of these functions will cause the firearm to malfunction in such a way as to prohibit the repetitive cyclical process of an autoloading firearm. Typical of the fire controls that have been used for such firearms are those shown in Crittendon, U.S. Pat. No. 2,675,638, hereby incorporated by reference.

In the case of semi-automatic shotguns, the loading phase can be particularly troublesome when firing magnum ammunition. Magnum ammunition tends to apply increased rotational and inertial forces to the components of the firearm. One possible malfunction occurs when the carrier rotates out of proper position to receive the next cartridge from the magazine tube. Because the carrier is subjected to rotational inertial effects when the gun fires, the carrier is rotated upwardly and the cartridge in the magazine tube is fed below the carrier and consequently falls to the ground. This is often called a "bomb-bay" malfunction by those skilled in the art.

To counteract the "bomb-bay" action and to prevent the carrier from rotating out of position at an improper time, there is a need for a device for temporarily locking the carrier.

SUMMARY OF THE INVENTION

The present invention provides a carrier lock device for use with a wide variety of semi-automatic firearms.

Specifically, the present invention provides, in a trigger assembly comprising a rotatably mounted trigger, a sear movable between at least engaged and disengaged positions and biased toward the engaged position, a hammer movable between at least cocked and fire positions and biased toward the fire position, at least one connector linking the trigger to the sear, and a bolt slidably mounted in a receiver between at least forward and rearward positions, the at least one connector being positioned to transmit a rearward force applied to the trigger to cause the sear to disengage the hammer and wherein the bolt, when urged towards the rearward position by inertial forces or blowback gasses, urges the hammer into the engaged position where it can be engaged by the sear; a carrier moveable between at least a first position and a second position and a magazine tube capable of storing at least one round of ammunition therein, wherein the carrier is positioned to convey a round of ammunition from the magazine to the receiver; a carrier lock moveable between at least a first and a second position; wherein the carrier lock contacts the carrier when in the first position; and wherein the carrier lock does not contact the carrier when in the second position.

The present invention also provides, in a firearm having a barrel, a trigger assembly, a bolt assembly comprising a hammer and hammer spring, a tubular magazine, and a carrier for delivery of a cartridge from the magazine into the barrel of the firearm, a carrier lock moveable between at least a first position where it contacts the carrier and prevents it from moving to deliver a cartridge, and a second position where it does not contact the carrier and allows the carrier to move to deliver a cartridge from the magazine into the barrel, the carrier lock being operatively connected to the hammer spring and urged by the hammer spring towards the first position.

DETAILED DESCRIPTION OF THE INVENTION

The present invention will be more fully understood by reference to the drawings, which show specific preferred embodiments of a device of the present invention. The device can be used as a component in a wide variety of firearms in addition to the firearms shown herein. Variations and modifications of the embodiments shown can be substituted without departing from the principles of the invention, as will be evident to those skilled in the art.

Preferred embodiments of the present invention can be incorporated into a trigger assembly of a firearm. Alternate embodiments include firearms wherein the present invention is incorporated into the barrel action, the receiver, or the magazine of the firearm.

Figure 1:
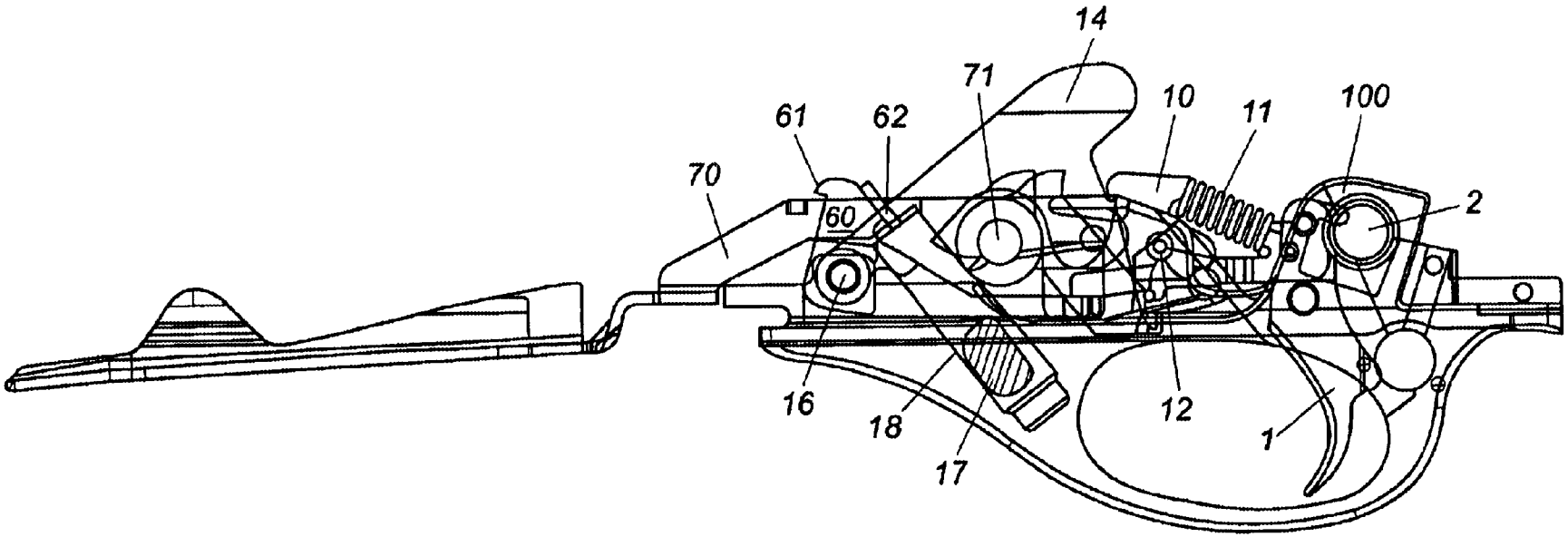
FIG. 1 is a side elevational view of a portion of a trigger assembly and action comprising a carrier lock of the present invention in the unlocked position.
Figure 2:
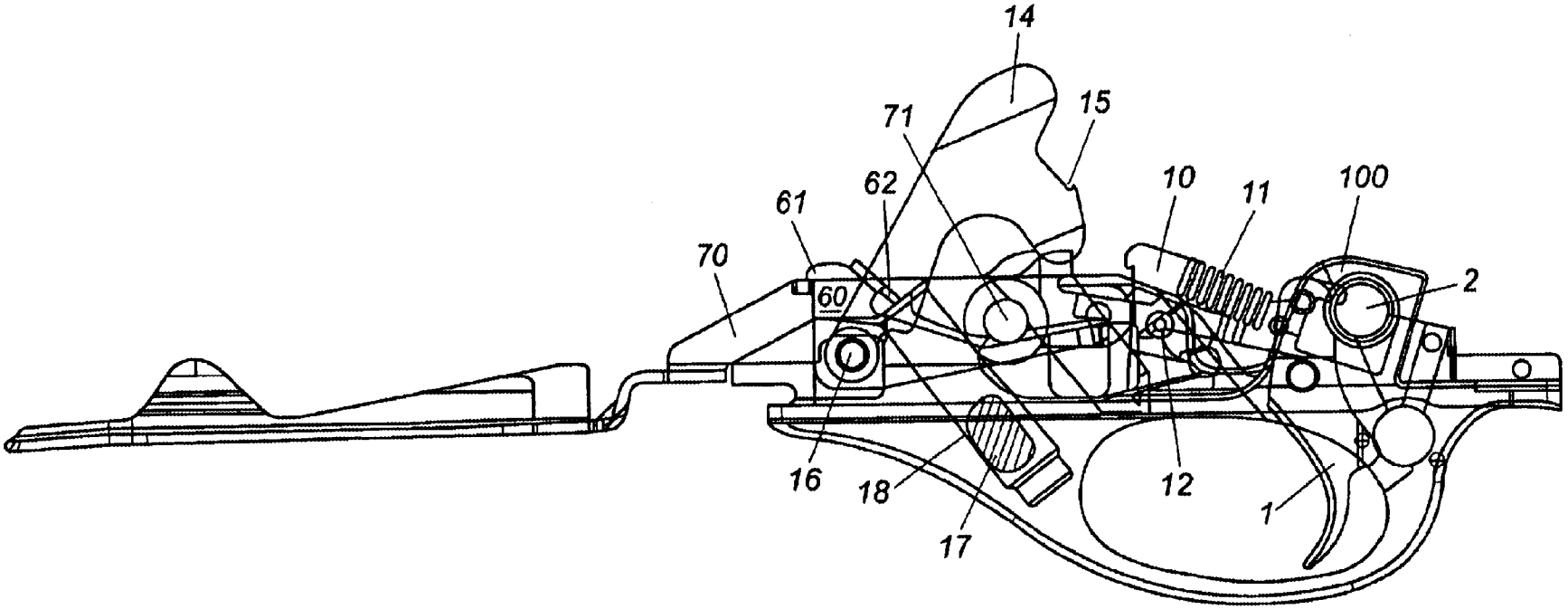
FIG. 2 is a side elevational view of the portion of the trigger assembly and action shown in FIG. 1 wherein the carrier lock of the present invention is in the locked position.
Figure 3:
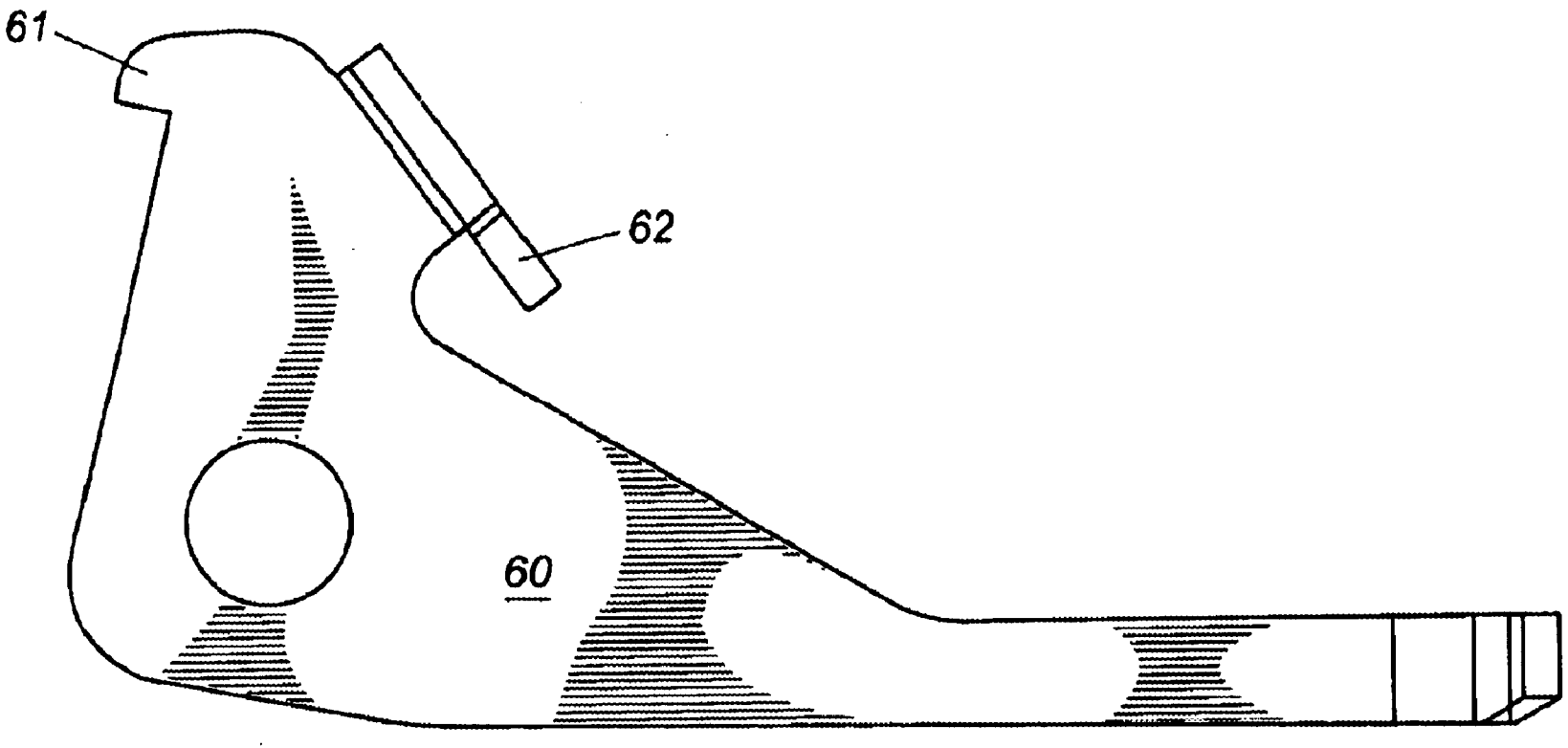
FIG. 3 is a side elevational view of the carrier lock shown in FIGS. 1 and 2.

In FIGS. 1 and 2, a preferred embodiment of the present invention is shown as a component of a trigger assembly or fire control of a firearm. FIG. 3 shows the preferred embodiment of the carrier lock of FIGS. 1 and 2.

FIGS. 1 and 2 are side elevational views showing some components of one possible trigger assembly that can include the present invention. Many types of trigger assemblies can be modified to incorporate the present invention, and the specific trigger assembly shown in FIGS. 1 and 2 is merely an example of one type of trigger assembly that can be used with a carrier lock of the present invention. From the following description and drawings, it will be evident to those skilled in the art that various embodiments of the present invention, with little modification, can be incorporated into a wide variety of trigger assemblies.

In FIG. 1, the trigger assembly components are shown in the cocked or ready to fire position. In FIG. 2, the trigger assembly components are shown in between the cocked and fire positions, where the hammer has been returned to position by the bolt, and the device of the present invention has disconnected the trigger from the sear.

In those Figures, trigger 1 is rotatably connected by trigger pivot pin 2, preferably to a housing 100. The trigger can be connected in any other manner, the manner or location of the connection not being crucial to the present invention. A link or multiple links can be used to connect the trigger to the sear. In addition, the present invention can be used in trigger assemblies having no links. When the connector or trigger is activated or pulled, the sear 10 is released. Typically, the sear 10 is rotatably connected by sear pivot pin 12, preferably to the housing. Preferably, sear is urged towards hammer 14 by sear spring 11. Again, the manner of connection of the sear is not crucial to the present invention.

The sear is positioned to rotate to the engaged position where it can engage hammer 14. Hammer 14 is rotatably connected to the housing by hammer pivot pin 16 and urged towards the front of the firearm by hammer spring 17. In FIG. 1, the trigger assembly is in the cocked or ready-to-fire position. Hammer 14 is engaged by sear 10 at hammer notch 15, thereby restraining hammer 14 from rotating toward the firing pin (not shown) under the force of hammer spring 17.

Carrier 70 is pivotally mounted to the housing 100 by the carrier pivot pin 71. The type and location of the carrier is not crucial to the present invention. Carrier 70 extends to the magazine (not shown) where it can lift or carry a round of ammunition from the magazine and into the chamber for firing.

Carrier lock 60 is pivotally mounted to housing 100 by the hammer pivot pin 16. The carrier lock shown is a preferred embodiment configured for the specific trigger assembly shown, and also functions as a trigger disconnect. The carrier lock comprises a forward end extending toward the muzzle end of the barrel of the firearm and a rearward end. At its forward end, the carrier lock 60 comprises a locking tab 61 extending forwardly and adapted to contact a portion of the carrier 70 to restrict its motion. Also at its forward end, the carrier lock comprises an activation arm 62 extending into a position where it contacts the hammer plunger 18. The activation arm 62 of the carrier lock can interact with the hammer plunger, which is urged upward by the hammer 14 and spring 17, so that the carrier lock can be urged towards and into a position where the locking tab 61 contacts the carrier 70 to prevent the carrier from rotating.

In FIG. 1, the trigger assembly is in the cocked or ready to fire position. In this position, the hammer is held down by the sear, and the hammer plunger is depressed against the force of the hammer spring. With the hammer spring compressed and the hammer plunger depressed, the activation arm 62 of the carrier lock 60 is free from contact with the plunger, and the carrier 70 is free to move upward and load a round of ammunition. When the trigger is pulled, releasing the hammer, the hammer plunger is urged upward by the hammer spring and into contact with the activation arm 62 of the carrier lock.

In FIG. 2, the carrier lock 60 has been urged into the locked position as a result of the hammer plunger contacting the activation arm 62 of the carrier lock and moving the carrier lock to a position where the locking tab 61 of the carrier lock contacts the carrier 70 to prevent it from moving until the hammer returns to the cocked position and the hammer plunger is depressed. When the hammer plunger is depressed by the hammer, the carrier lock returns to the unlocked position, as shown in FIG. 1.

We claim:

1. A trigger assembly for a firearm comprising a rotatably mounted trigger, a sear movable between at least engaged and disengaged positions and biased toward the engaged position, a hammer movable between at least cocked and fire positions and biased toward the fire position, at least one connector linking the trigger to the sear, and a bolt slidably mounted in a receiver between at least forward and rearward positions, the at least one connector being positioned to transmit a rearward force applied to the trigger to cause the sear to disengage the hammer and wherein the bolt, when urged towards the rearward position by inertial forces or blowback gasses, urges the hammer into the engaged position where it can be engaged by the sear;

a carrier moveable between at least a first position and a second position and a magazine tube capable of storing at least one round of ammunition therein, wherein the carrier is positioned to convey a round of ammunition from the magazine to the receiver, and a carrier lock moveable between at least a first position wherein the carrier lock contacts the carrier and prevents movement of the carrier when the hammer is in its fire position; and a second position, wherein the carrier lock does not contact the carrier so as to enable movement of the carrier to convey the round of ammunition to the receiver.

2. In a trigger assembly of claim 1, a carrier lock device moveably mounted and positioned to be urged into contact with the carrier when the carrier is in the second position and preventing the carrier from moving to the first position.

3. A carrier lock of claim 2 mounted to the trigger assembly.

4. A carrier lock of claim 2 mounted to the receiver of a firearm.

5. A carrier lock of claim 2 urged into contact with the carrier by the hammer or the hammer spring.

6. In a firearm having a barrel, a trigger assembly, a bolt assembly comprising a hammer and hammer spring, a tubular magazine, and a carrier for delivery of a cartridge from the magazine into the barrel chamber of the firearm, a carrier lock moveable between at least a first position where it contacts the carrier and prevents it from rotating, and a second position where it does not contact the carrier and allows the carrier to rotate to deliver a cartridge from the magazine into the barrel chamber, the carrier lock being operatively connected to the hammer spring and urged by the hammer spring towards the first position.

7. A trigger assembly for a firearm, comprising:

a carrier moveable between a first position wherein the carrier is enabled to move a round of ammunition into a position within the firearm for firing, and second position; and a moveable carrier lock positioned adjacent the carrier and having a locking tab adapted to engage the carrier for locking the carrier in its second position and against movement as the round of ammunition is being fired by the firearm and wherein the carrier lock is moveable away from contact with the carrier toward an unlocked position to enable movement of the carrier between its first and second positions as the firearm is cocked for firing a next round of ammunition.

* * * * *